US008330779B2

(12) United States Patent
Le et al.

(10) Patent No.: US 8,330,779 B2
(45) Date of Patent: Dec. 11, 2012

(54) ADC CALIBRATION FOR COLOR ON LCD WITH NO STANDARDIZED COLOR BAR FOR GEOGRAPHIC AREA IN WHICH LCD IS LOCATED

(75) Inventors: Louis Le, San Diego, CA (US); Tuan Pham, San Diego, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 653 days.

(21) Appl. No.: 12/570,794

(22) Filed: Sep. 30, 2009

(65) Prior Publication Data

US 2011/0074832 A1 Mar. 31, 2011

(51) Int. Cl.
*G09G 3/36* (2006.01)

(52) U.S. Cl. ..... 345/690

(58) Field of Classification Search ..... 348/182
See application file for complete search history.

(56) References Cited

U.S. PATENT DOCUMENTS

| | | | | |
|---|---|---|---|---|
| 4,706,108 | A * | 11/1987 | Kumagai et al. | 348/178 |
| 5,164,726 | A | 11/1992 | Berstein et al. | |
| 5,369,432 | A | 11/1994 | Kennedy | |
| 5,455,620 | A * | 10/1995 | Stevens et al. | 348/184 |
| 6,459,457 | B1 * | 10/2002 | Renner et al. | 348/668 |
| 6,833,875 | B1 * | 12/2004 | Yang et al. | 348/665 |
| 7,545,299 | B2 | 6/2009 | Tsai et al. | |
| 2004/0223000 | A1 * | 11/2004 | Lin | 345/604 |
| 2007/0258200 | A1 * | 11/2007 | Choi et al. | 361/681 |
| 2010/0097535 | A1 * | 4/2010 | Inoue et al. | 349/38 |

* cited by examiner

*Primary Examiner* — Hoa T Nguyen
*Assistant Examiner* — Mark Fischer
(74) *Attorney, Agent, or Firm* — John L. Rogitz

(57) ABSTRACT

Instead of estimating a saturation value for an ADC color comb register of an LCD made in a region without a standard color bar, a standard color bar of another geographic region is used to calculate the saturation value for the register so as to optimize the color of images presented on the LCD.

12 Claims, 3 Drawing Sheets

ADC CALIBRATION FOR COLOR ON LCD WITH NO STANDARDIZED COLOR BAR FOR GEOGRAPHIC AREA IN WHICH LCD IS LOCATED

FIELD OF THE INVENTION

The present application relates generally to calibrating liquid crystal display (LCD) analog-to-digital converters (ADC) for color in a geographic manufacturing area that does not have a standardized color bar.

BACKGROUND OF THE INVENTION

In production, LCDs such as TV LCDs typically are adjusted to optimize the picture. These adjustments consist primarily of ADC register adjustment and white balance adjustments. Present principles are directed to ADC adjustments.

In many cases, ADC adjustment is performed by alternately repeating gain adjustment and bias adjustment through settings of the registers in the ADC. In other words, in the case of Y signal adjustment, a bias adjustment is performed by inputting a blackout signal and a gain adjustment is performed by inputting a whiteout signal. Moreover, with tracking being adjusted, gain adjustment and bias adjustment are alternately repeated. When the ADC employs a digital clamp component, bias adjustment (and thus tracking) are unnecessary.

In either case, to adjust the color-related registers of the ADC to optimize the picture, a standard color bar normally is input to the LCD, which is used to appropriately establish register values. As understood herein, because LCDs made in different geographic regions may entail respectively different broadcasting, reception, and display standards, different calibration color bars typically are used in different geographic regions for optimum ADC calibration.

As also understood herein, some geographic regions might not have a defined, accepted calibration color bar. Present principles understand that ADC register adjustments in such regions may simply estimate what the proper register value should be using an approximation, which does not always lead to accurate picture colorization.

SUMMARY OF THE INVENTION

The details of the present invention, both as to its structure and operation, can best be understood in reference to the accompanying drawings, in which like reference numerals refer to like parts, and in which:

DETAILED DESCRIPTION OF THE PREFERRED EMBODIMENT

Figure 1:
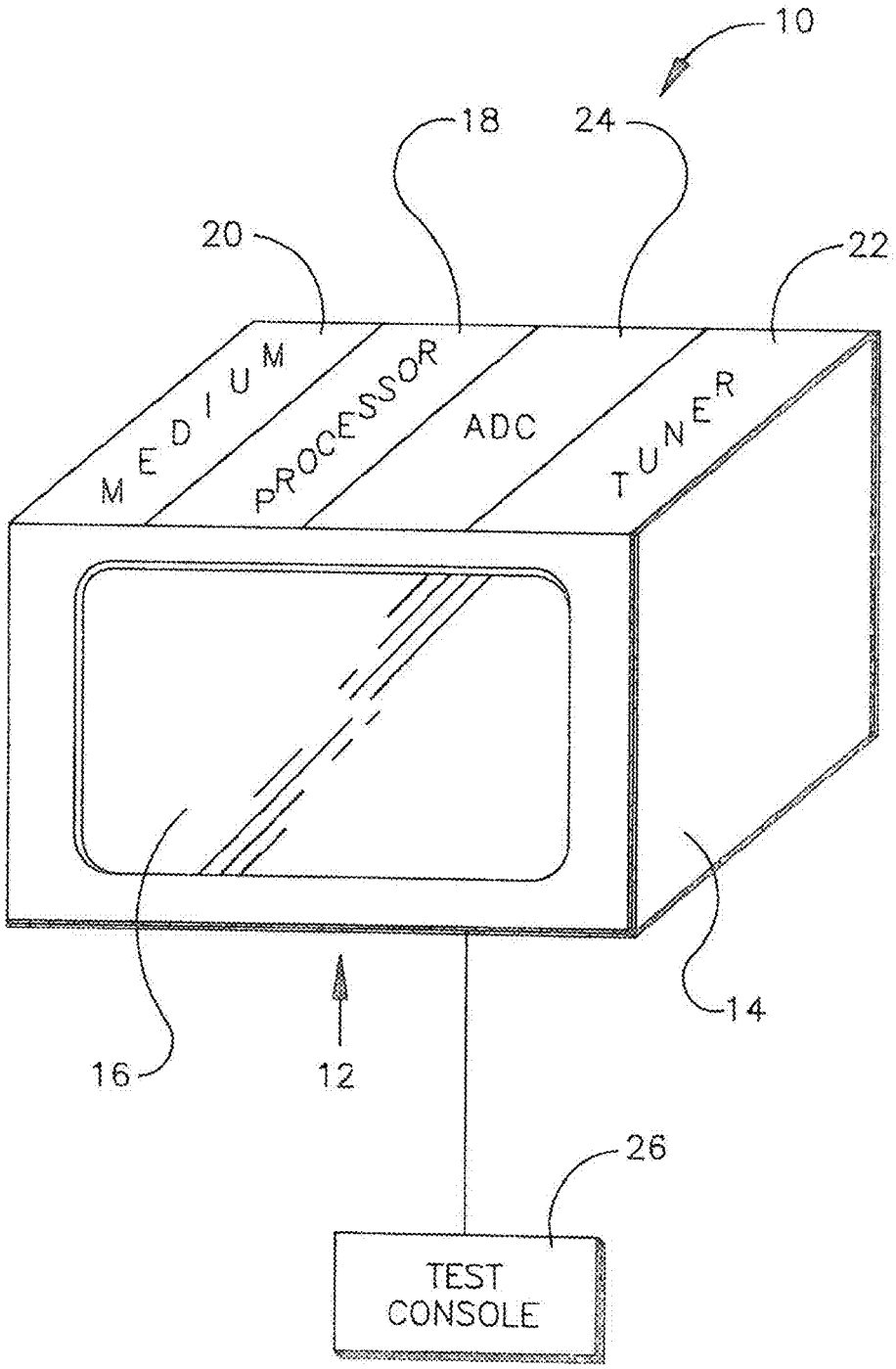
FIG. 1 is a block diagram of an example system in accordance with present principles.

Referring initially to FIG. 1, a system 10 is shown that includes a TV 12 with TV chassis 14 bearing a TV display 16 such as but not limited to a flat panel matrix or plasma display, and more particularly a liquid crystal display (LCD), it being understood that present principles may apply to LCDs in components other than TVs. The display 16 is controlled by a TV processor 18 accessing a computer readable storage medium 20. The computer readable storage medium may be solid state or disk-based storage containing data and instructions to the TV processor 18 to execute portions of the logic divulged below. Typically, the processor 18 receives signals from an analog-to-digital converter (ADC) assembly 24, described further below. It is to be understood that while FIG. 1 shows that the processor 18, medium 20, and TV tuner 22 are in the chassis 14, in alternate embodiments one or more of these components may be separately housed in, e.g., a set-top box. In any case, during manufacturing the TV 12 may receive test and calibration signals from a test console 26 such as but not limited to a Shibasoku or Phillips test console.

Figure 2:
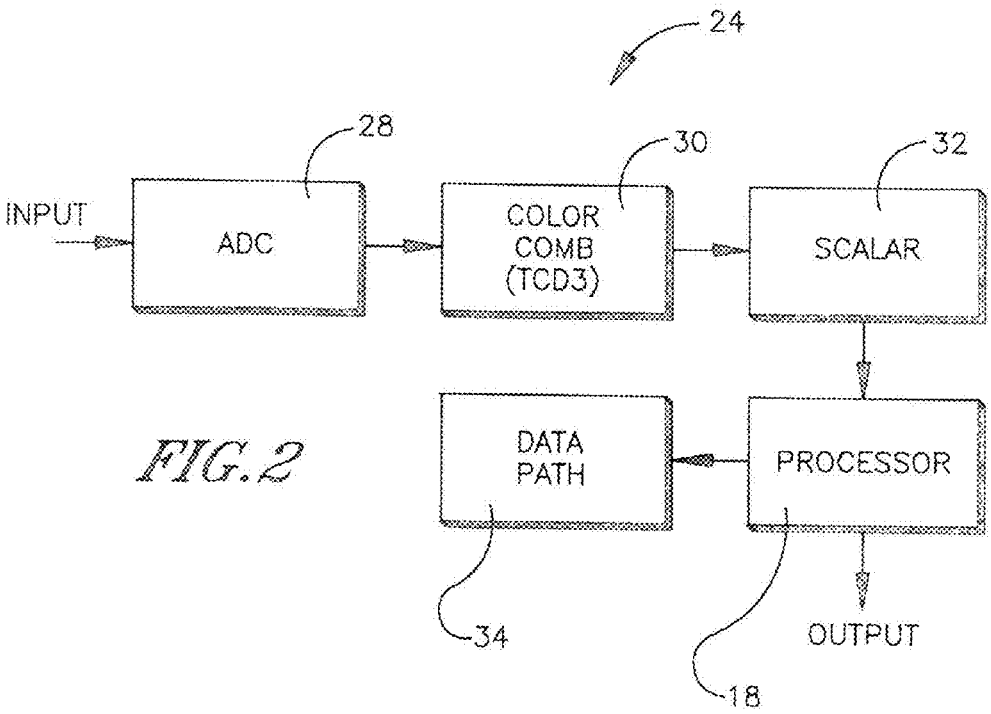
FIG. 2 is a block diagram of an example ADC assembly.

FIG. 2 shows that the example ADC assembly 24 may include an ADC 28 receiving input from the test console 26 and sending output to a color comb 30 such as a Sony TCD3 color comb. The color comb 30 may be associated with registers the values of which can be adjusted in accordance with present principles, it being understood that in alternate implementations the ADC assembly 24 may include more or less components than those shown in FIG. 2 and, thus, that the register values which are established may be for registers in, e.g., an ADC itself.

In any case, in the example ADC assembly 24 shown, the output of the color comb 30 may be sent to a scalar component 32 which in turn feeds the processor 18. The processor 18 may provide multiple outputs including to a data path 34 as shown.

Figure 3:
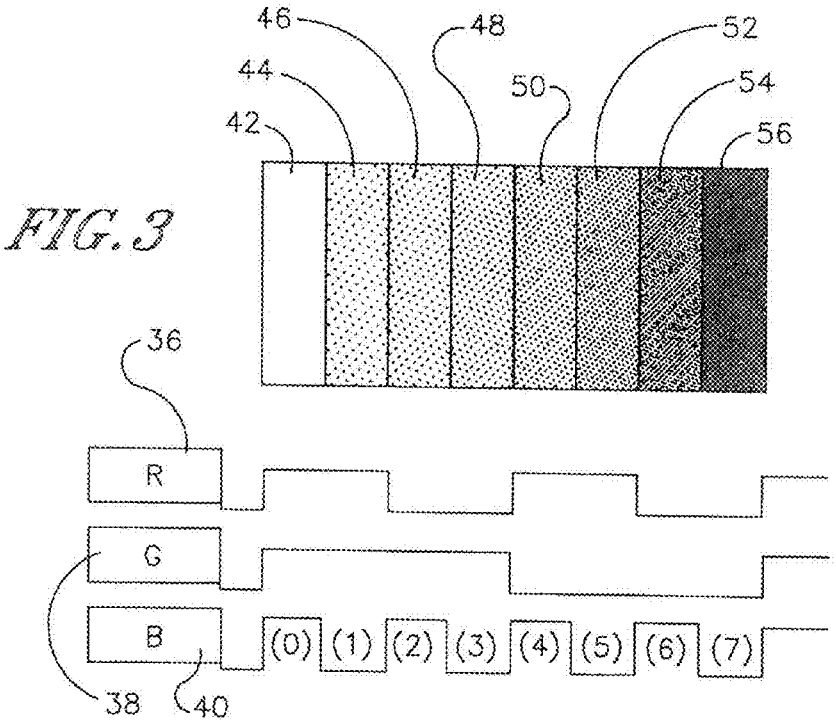
FIG. 3 is a schematic diagram of a color bar.

In some implementations the display 16 may be manufactured in one geographic region such as Argentina that does not employ a standard color bar for calibration purposes, in which case a standard color bar from another geographic region such as Europe may be used in accordance with logic described below, even though the European color bar in this example is not defined to be standard in Argentina. Such a color bar is illustrated in FIG. 3, in which red ("R"), green ("G"), and blue ("B") inputs establish eight primary colors of the color bar as follows. As shown in FIG. 3, when all three RGB inputs are received as indicated by all three waveforms associated with the inputs 36-40 being in a high state, a white area 42 is established. On the other hand, when only red and green are received with blue being in a low state, a yellow area 44 is established. When green and blue but not red are high, a cyan area 46 is established, and when only green is high, a green area 48 is established. Blue and red together establish a magenta area 50, red alone establishes a red area 52, and blue alone establishes a blue area 54. A black area 56 of the color bar is established when all three color inputs are low as shown. The areas 42-56 thus are all monochrome areas of different colors from each other.

Figure 4:
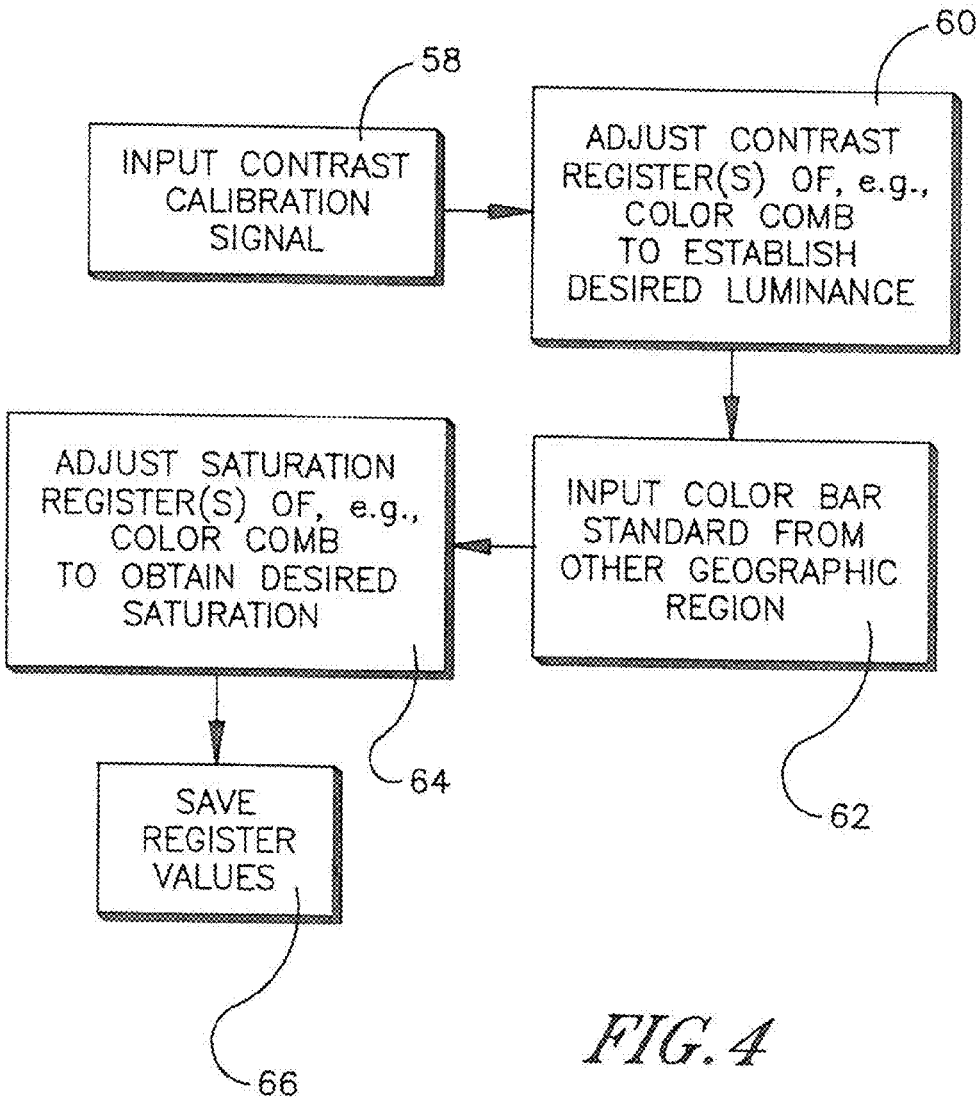
FIG. 4 is a flow chart of example logic that can be used in accordance with present principles.

FIG. 4 shows example logic in accordance with present principles for eliminating color adjustment based on an estimation only when the LCD is made in a geographic region without a standard color bar and instead adjusting color using a calculation based on a standard color bar from another geographic region. Commencing at block 58, a contrast calibration signal is input from the test console 26 to the ADC assembly 24. At block 60, the values of one or more contrast registers of the ADC assembly 24, e.g., one or more contrast registers of the color comb 30, are adjusted and the resultant output of the ADC assembly 24 measured. The values are adjusted until a desired luminance value is obtained.

Next proceeding to block 62, the example standard color bar from another geographic region is input to the ADC assembly 24. At block 64, the values of one or more saturation registers of the ADC assembly 24, e.g., the values of one or more saturation registers of the color comb 30, are adjusted so as to obtain a desired saturation output value, e.g., at the output of the scalar 32. In one example embodiment, the saturation values are adjusted as necessary such that the absolute value of the difference between the average color value of one color bar area, e.g., the blue area 54, and the average color value of another color bar area, e.g., the magenta area 50, equals a predetermined absolute value, in this hypothetical, two. Both the blue and magenta can be adjusted together, with the rate of "blue" gain in the blue area being faster than the rate of "blue" gain in the magenta such that the blue value in the blue area eventually surpasses the blue value in magenta by, in this example, "2". At block 66 the register values satisfying the conditions above are saved.

While the particular ADC CALIBRATION FOR COLOR ON LCD WITH NO STANDARDIZED COLOR BAR FOR GEOGRAPHIC AREA IN WHICH LCD IS LOCATED is herein shown and described in detail, it is to be understood that the subject matter which is encompassed by the present invention is limited only by the claims.

What is claimed is:

1. A method for calibrating an analog-to-digital converter (ADC) assembly in a display configured for use in a first geographic region for which no standardized calibration color bar is defined, comprising:

receiving as calibration input color bar information standardized for use in a second geographic region different from the first geographic region; and establishing a value of at least one register in the ADC assembly based at least in part on the color bar information;

wherein two and only two monochrome areas of the color bar information are used to establish the value; and wherein the two areas are a blue area and a magenta area.

2. The method of claim 1, wherein the register is a color comb register.

3. The method of claim 1, further comprising establishing a register value in the ADC assembly to produce a desired output luminance.

4. The method of claim 1, wherein the value is adjusted to obtain an absolute value of a difference between an average value of a first monochrome area and an average value of a second monochrome area that is substantially equal to a predetermined absolute value.

5. An apparatus comprising:

a liquid crystal display (LCD); and an analog-to-digital converter (ADC) assembly receiving analog signals and outputting digitized signals for presentation by the LCD, the ADC assembly including at least one register having a value defining color saturation derived from obtaining an absolute value of a difference between an average value of a first monochrome area of a color bar and an average value of a second monochrome area of the color bar that is equal to a predetermined absolute value wherein two and only two monochrome areas are used to establish the value; and wherein the two areas are a blue area and a magenta area.

6. The apparatus of claim 5, wherein the color bar is standardized for use in a geographic region that is different from the geographic region in which the LCD is manufactured.

7. The apparatus of claim 5, wherein the register is a color comb register.

8. The apparatus of claim 5, further comprising a register value in the ADC assembly that is established to produce a desired output luminance.

9. A method, comprising:

providing a liquid crystal display (LCD) in a geographic region not having a standardized color bar; and instead of estimating a saturation value for a register of an ADC assembly associated with the LCD, using a standard color bar information of another geographic region to calculate a saturation value for the register so as to optimize the color of images presented on the LCD;

wherein two and only two monochrome areas are used to establish the value; and wherein the two areas are a blue area and a magenta area.

10. The method of claim 9, wherein the register is a color comb register.

11. The method of claim 9, further comprising establishing a register value in the ADC assembly to produce a desired output luminance.

12. The method of claim 9, wherein the value is adjusted to obtain an absolute value of a difference between an average value of a first monochrome area and an average value of a second monochrome area that is substantially equal to a predetermined absolute value.

* * * * *